US012364319B2

(12) United States Patent
Hsu

(10) Patent No.: US 12,364,319 B2
(45) Date of Patent: Jul. 22, 2025

(54) HAIRCLIP

(71) Applicant: Kuo-Yang Hsu, Tainan (TW)

(72) Inventor: Kuo-Yang Hsu, Tainan (TW)

( * ) Notice: Subject to any disclaimer, the term of this patent is extended or adjusted under 35 U.S.C. 154(b) by 307 days.

(21) Appl. No.: 18/311,976

(22) Filed: May 4, 2023

(65) Prior Publication Data

US 2024/0365944 A1 Nov. 7, 2024

(51) Int. Cl.
*A45D 8/20* (2006.01)

(52) U.S. Cl.
CPC ..... *A45D 8/20* (2013.01)

(58) Field of Classification Search
CPC ... A45D 8/20; A45D 8/22; A45D 8/24; A45D 8/26; A45D 8/28; A45D 8/30; A45D 2/42; A45D 6/14; A45D 6/145
See application file for complete search history.

(56) References Cited

U.S. PATENT DOCUMENTS 4,508,124 A * 4/1985 Franzino ..... A45D 2/36 132/277
5,697,388 A * 12/1997 Chang ..... A45D 8/20 132/277
6,035,863 A * 3/2000 Mao ..... A45D 8/20 132/273
D642,738 S * 8/2011 Hsu ..... D28/40
9,232,841 B1 * 1/2016 Hsu ..... A45D 8/20
11,653,736 B2 * 5/2023 Hsu ..... C08K 3/26 132/277
2007/0131237 A1 * 6/2007 Tu ..... A45D 8/20 132/277
2008/0149129 A1 * 6/2008 Yang ..... A45D 8/20 132/277
2009/0277469 A1 * 11/2009 Hsu ..... A45D 8/20 132/277
2010/0108091 A1 * 5/2010 Lay ..... A45D 8/28 132/279
2023/0232925 A1 * 7/2023 Hsu ..... C08L 67/04 132/277
2023/0404232 A1 * 12/2023 Tu ..... A45D 8/20

* cited by examiner

*Primary Examiner* — Tatiana L Nobrega
(74) *Attorney, Agent, or Firm* — Best & Flanagan LLP

(57) ABSTRACT

A hairclip comprises two pivotably connected clip bodies each including a pressing portion having a through-hole with a pressing side. Each clip body includes an outer side having a coupling portion which includes a first coupling groove adjacent to the through-hole and a second coupling groove remote to the through-hole. An arcuate elastic element includes extends through the through-holes. Two ends of the elastic element are coupled with the first coupling grooves respectively. When the clip bodies are opened, the pressing sides press against the elastic element and the ends of the elastic element couple with the second coupling grooves. When the clip bodies are closed to an extent where the second coupling grooves are incapable of retaining the ends of the elastic element, the ends of the elastic element automatically disengage from the second coupling grooves and displace to a position for coupling with the first coupling grooves.

7 Claims, 11 Drawing Sheets

HAIRCLIP

BACKGROUND OF THE INVENTION

The present invention relates to a hairclip and, more particularly, to a hairclip with an elastic element for clamping hair.

A conventional hairclip generally includes two clip bodies and an elastic element disposed between the two clip bodies. The two clip bodies can clamp hair under the elastic force of the elastic element. The elastic element is generally a metal torsion spring. However, the torsion spring is apt to oxidize and rust after a period of time, providing poor quality sensation and shortening the service life.

A hairclip using an arcuate elastic element shown in FIGS. 10 and 11 has been provided to improve the drawbacks of the above hairclip. Examples of the hairclip are disclosed in U.S. Patent Publication Nos. 20090277469 and 20080149129 and U.S. Pat. No. 9,232,841. The hairclip includes two clip bodies 1' and an elastic element 2'. Each clip body 1' includes a clamp portion 11' at a lower end thereof and a pressing portion 12' at an upper end thereof. Each pressing portion 12' has a through-hole 121'. Each clip body 1' has a pivotal portion 13' disposed on an inner side thereof, and a coupling groove 14' is disposed below the through-hole 121'.

The elastic element 2' is substantially a C-shaped ring having a cross section larger than a semi-circle and includes an opening 21' at a lower end thereof and two ends 22'. The elastic element 2' extends through the through-holes 121' of the two clip bodies 1', and the two ends 22' of the elastic element 2' expand to securely couple with the coupling grooves 14' of the two clip bodies 1', respectively. The two ends 22' have a spacing D1 therebetween.

The pressing portions 12' may be pressed to open the hairclip, such that the elastic element 2' moves upward relative to the clamp portions 11' of the two clip bodies 1', thereby expanding the two ends 22' of the elastic element 2'. Thus, the spacing D1 between the two ends 22' increases. When the two pressing portions 12' abut each other, the two ends 22' have a maximum spacing D2 therebetween, and the elastic element 2' may provide an elastic returning force for clamping hair.

Therefore, the larger the maximum spacing D2, the greater the elastic returning force, providing enhanced hair clamping stability. However, the two ends 22' of the elastic element 2' are limited by the pivotal angle of the two clip bodies 1' and the abutment of the pressing portions 12'. As a result, the clamping force is small, because the maximum spacing D2 between the two ends 22' of the elastic element 2' is not enough.

Furthermore, in a design, the spacing between the two ends 22' of the elastic element 2' may be greater than the above spacing D1 after of the elastic element 2' is assembled with the two clip bodies 1', such that the spacing between the two ends 22' of the elastic element 2' may be greater than the above spacing D2 when the two clip bodies 1' expand to the position where the two pressing portions 12' abut each other, providing a larger elastic returning force for clamping. However, when this design is not in use, the two ends 22' of the elastic element 2' remains in a larger expanded state (in which the spacing between the two ends 22' is greater than D1) for a long period of time, which easily causes elastic fatigue and reduction in the clamping force of the elastic element 2'.

BRIEF SUMMARY OF THE INVENTION

An objective of the present invention is to provide a hairclip providing enhanced elastic clamping force and prolonging the service life of the elastic element.

A hairclip according to the present invention comprises two clip bodies and an elastic element. The two clip bodies are substantially symmetric to each other in structure. Each of the two clip bodies includes a clamp portion at a lower end thereof, a pressing portion at an upper end thereof, and a pivotal portion for pivotal coupling of the two clip bodies. Each pressing portion includes a through-hole having a pressing side at an upper end thereof. Each of the two clip bodies further includes an outer side having a coupling portion below the through-hole. The coupling portion of each of the two clip bodies includes a first coupling groove adjacent to the through-hole and a second coupling groove remote to the through-hole. The elastic element is in a form of an arcuate member. The elastic element includes two ends delimiting an opening at a lower end of the elastic element. The elastic element extends through the through-holes of the two clip bodies. Each of the two ends of the elastic element is coupled with the first coupling groove of a respective one of the two clip bodies. When the two clip bodies are opened, each pressing side presses against the elastic element and causes displacement of a respective one of the two ends of the elastic element to couple with the second coupling groove of the respective one of the two clip bodies. When the two clip bodies are closed to an extent where the second coupling grooves are incapable of retaining the two ends of the elastic element, the two ends of the elastic element automatically disengage from the second coupling grooves and displace to a position for coupling with the first coupling grooves of the two clip bodies.

In an example, the first coupling groove of each of the two clip bodies includes a first retaining side extending toward the through-hole and a first inclined guiding side extending away from the through-hole and toward the second coupling groove.

In an example, the second coupling groove of each of the two clip bodies includes a second retaining side extending toward the through-hole and a second inclined guiding side located between the first inclined guiding side and the second retaining side and extending toward the second coupling groove.

The two pressing portions can be moved toward each other, and the pressing sides press against the top end of the elastic element to cause downward movement of the elastic element. Thus, the two ends of the elastic element are subjected to a force to expand outward, thereby moving to the second coupling grooves. Therefore, the elastic returning force is greater for clamping hair, and the hair clamping stability is enhanced. Furthermore, when not in use or only a small amount of hair is to be clamped, the two clamp portions are pivoted downward, and the two ends of the elastic element displace to and are positioned in the first coupling grooves under the elastic returning force. Furthermore, the spacing between the two ends of the elastic element can be reduced to avoid elastic fatigue of the elastic element while prolonging the service lives of the elastic element and the hairclip.

The present invention will become clearer in light of the following detailed description of illustrative embodiments of this invention described in connection with the drawings.

DETAILED DESCRIPTION OF THE INVENTION

Figure 1:
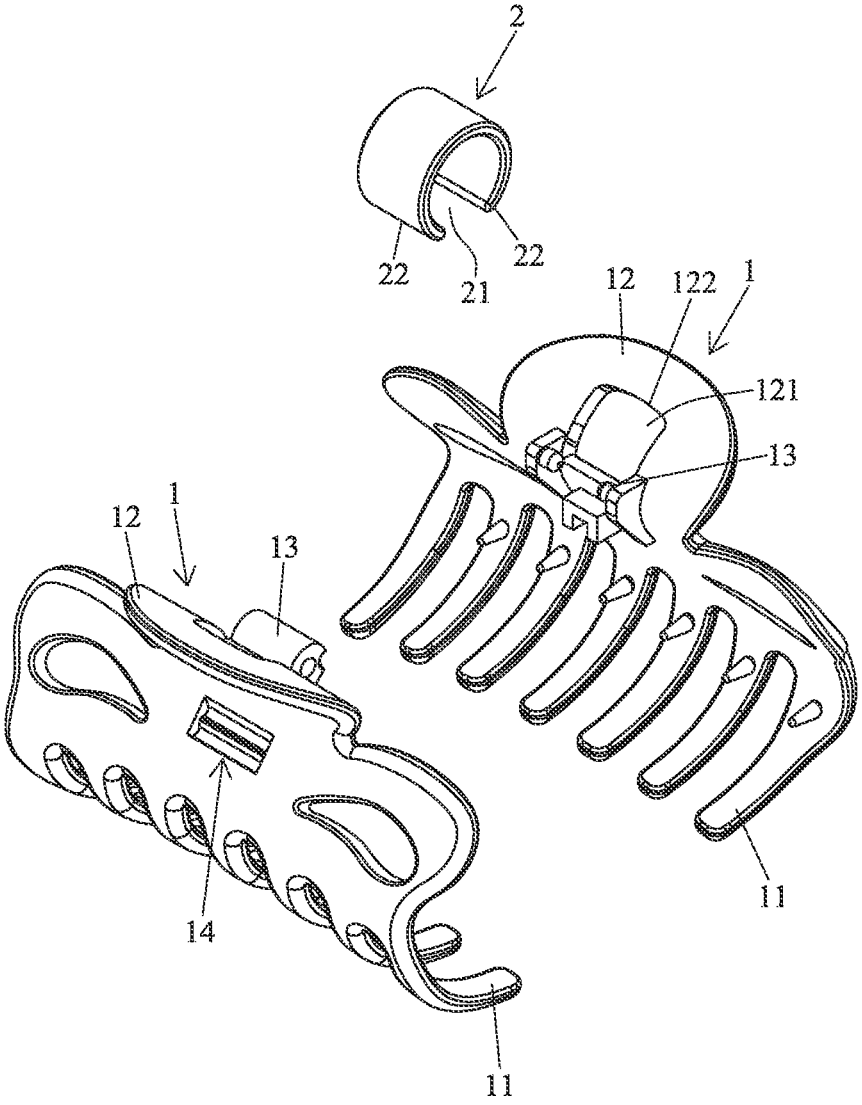
FIG. 1 is an exploded, perspective view of a hairclip of a first embodiment according to the present invention.
Figure 2:
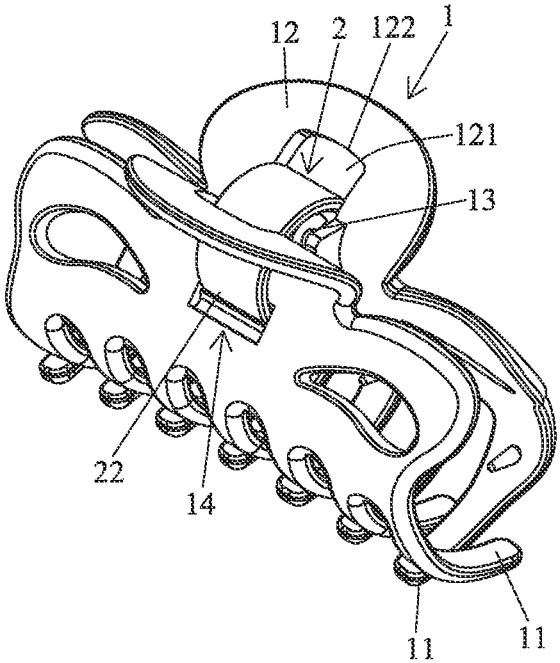
FIG. 2 is a perspective view of the hairclip of the first embodiment according to the present invention after assembly.
Figure 3:
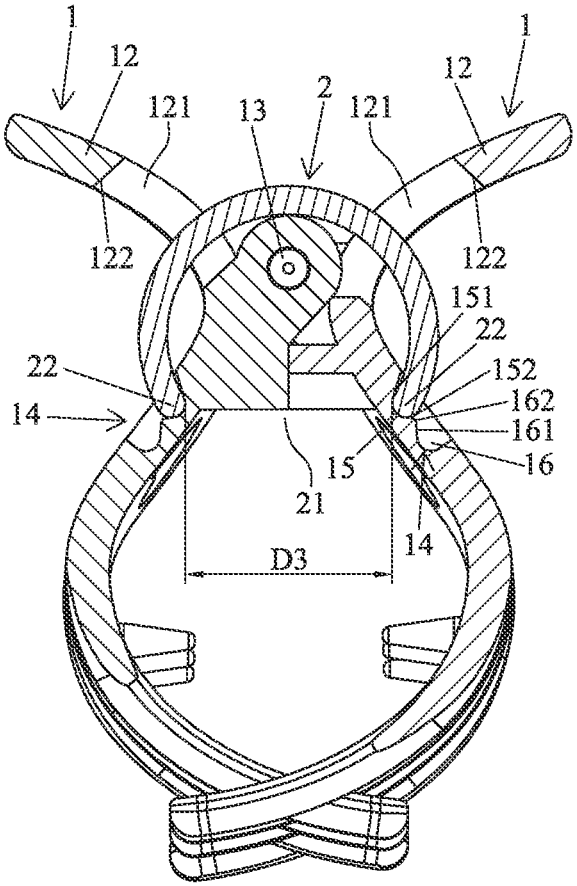
FIG. 3 is a cross sectional view of the hairclip of the first embodiment according to the present invention after assembly.

In the embodiments below, elements having similar functions will be designated by the same reference numbers. The terms "upper" and "lower" referred to herein are merely used to explain the invention in connection with the drawings, rather than limiting the invention. With reference to FIGS. 1-3, a hairclip of a first embodiment according to the present invention comprises two clip bodies 1 and an elastic element 2. The two clip bodies 1 are substantially symmetric in structure. Each of the two clip bodies 1 includes a clamp portion 11 at a lower end thereof and a pressing portion 12 at an upper end thereof. Furthermore, each of the two clip bodies 1 includes a pivotal portion 13 at an inner side thereof for pivotal coupling of the two clip bodies 1. Each pressing portion 12 includes a through-hole 121 having a pressing side 122 at an upper end thereof.

Furthermore, each of the two clip bodies 1 includes an outer side having a coupling portion 14 below the through-hole 121. The coupling portion 14 of each of the two clip bodies 1 includes a first coupling groove 15 adjacent to the through-hole 121 and a second coupling groove 16 remote to the through-hole 121. The first coupling groove 15 of each of the two clip bodies 1 includes a first retaining side 151 extending toward the through-hole 121 and a first inclined guiding side 152 extending away from the through-hole 121 and toward the second coupling groove 16. The second coupling groove 16 of each of the two clip bodies 1 includes a second retaining side 161 extending toward the through-hole 121 and a second inclined guiding side 162 located between the first inclined guiding side 152 and the second retaining side 161 and extending toward the second coupling groove 16.

In this embodiment, the elastic element 2 is made of elastic plastic material and is substantially a C-shaped ring having a cross section larger than a semi-circle. The elastic element 2 includes two ends 22 delimiting an opening 21 at a lower end of the elastic element 2. In other embodiments, the elastic element 2 may be made of non-plastic material.

The elastic element 2 extends through the through-holes 121 of the two clip bodies 1. Each of the two ends 22 of the elastic element 2 is coupled with the first coupling groove 15 of a respective one of the two clip bodies 1. Thus, the two ends 22 may have a spacing D3 therebetween, as shown in FIG. 3. Each of the two ends 22 of the elastic element 2 is retained and positioned by the first retaining side 151 of a respective first coupling groove 15. Thus, the two clip bodies 1 can provide a clamping function under the elastic force of the elastic element 2.

Figure 4:
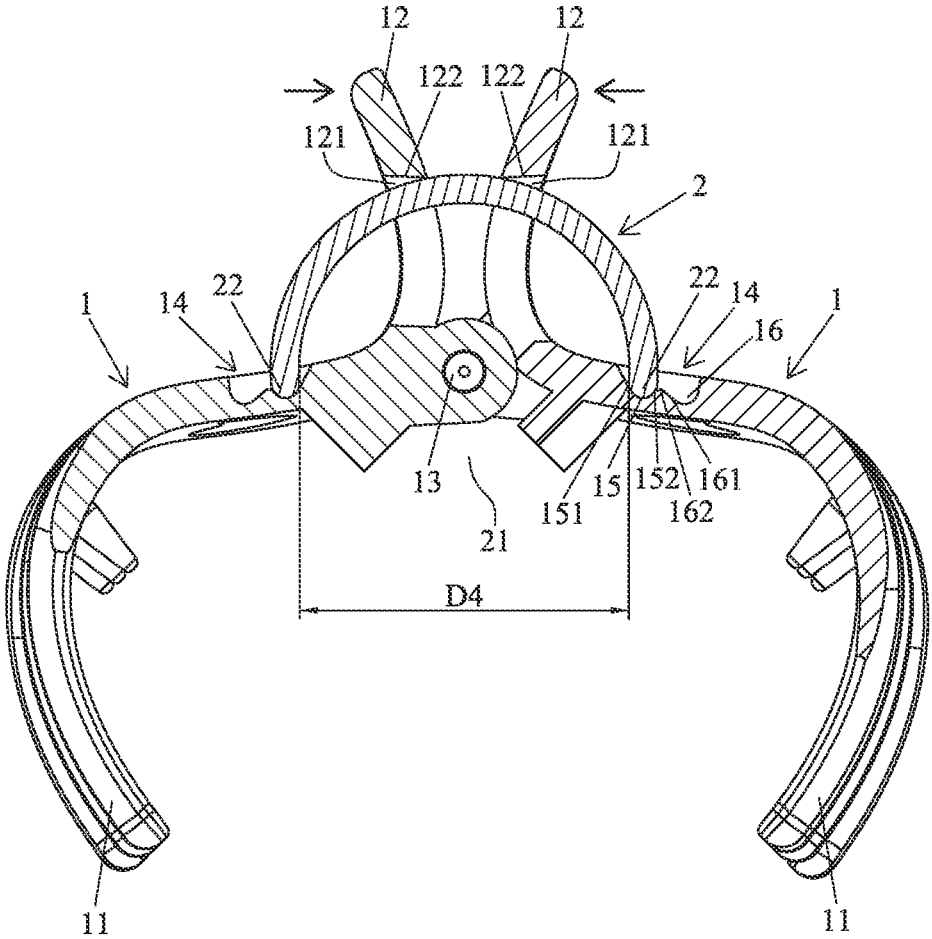
FIG. 4 is a schematic cross sectional view of the hairclip of the first embodiment according to the present invention after assembly with two clip bodies in an open position and with an elastic element coupled with first coupling grooves of coupling portions of the two clip bodies.

With reference to FIG. 4, the pressing portions 12 of the two clip bodies 1 can be pressed to move toward each other, and the two clamp portions 11 pivot upward and away from each other. At the same time, the elastic element 2 expands. When the pressing sides 122 of the through-holes 121 abut the top face of the elastic element 2, the two ends 22 are in an expanded state and have a spacing D4 therebetween.

Figure 5:
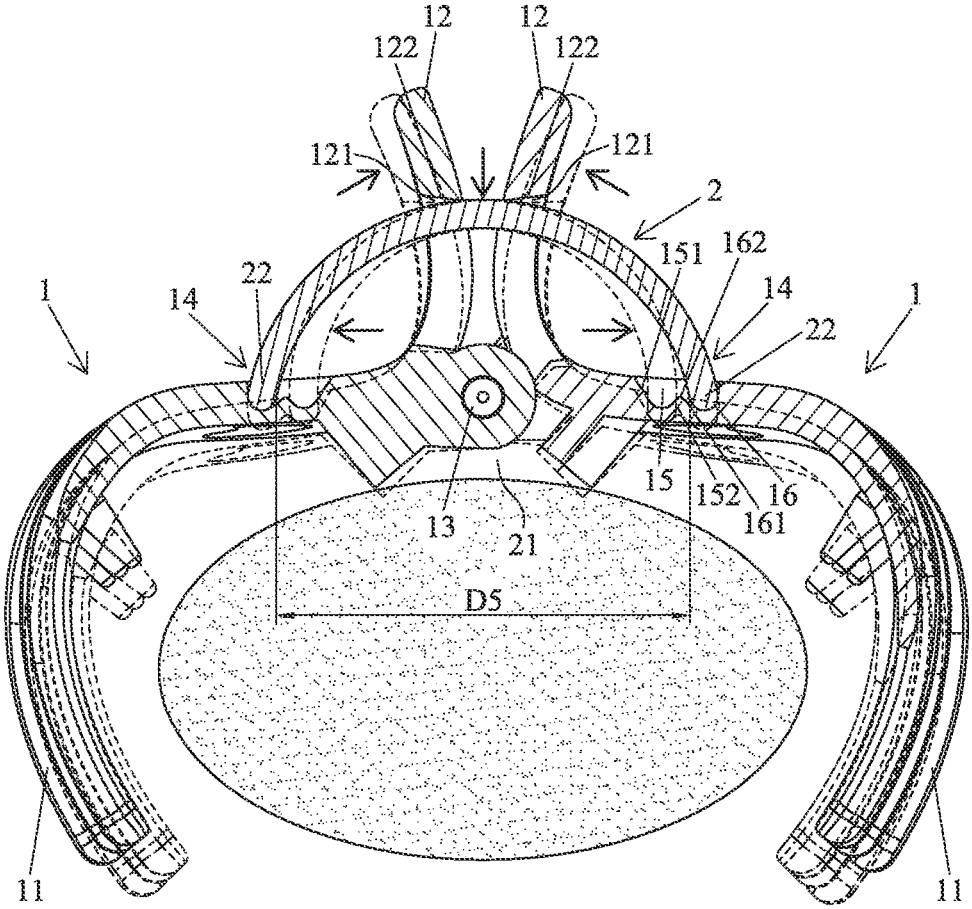
FIG. 5 is a schematic cross sectional view of the hairclip of the first embodiment according to the present invention after assembly with the two clip bodies in an open position and with the elastic element coupled with second coupling grooves of the coupling portions of the two clip bodies.
Figure 6:
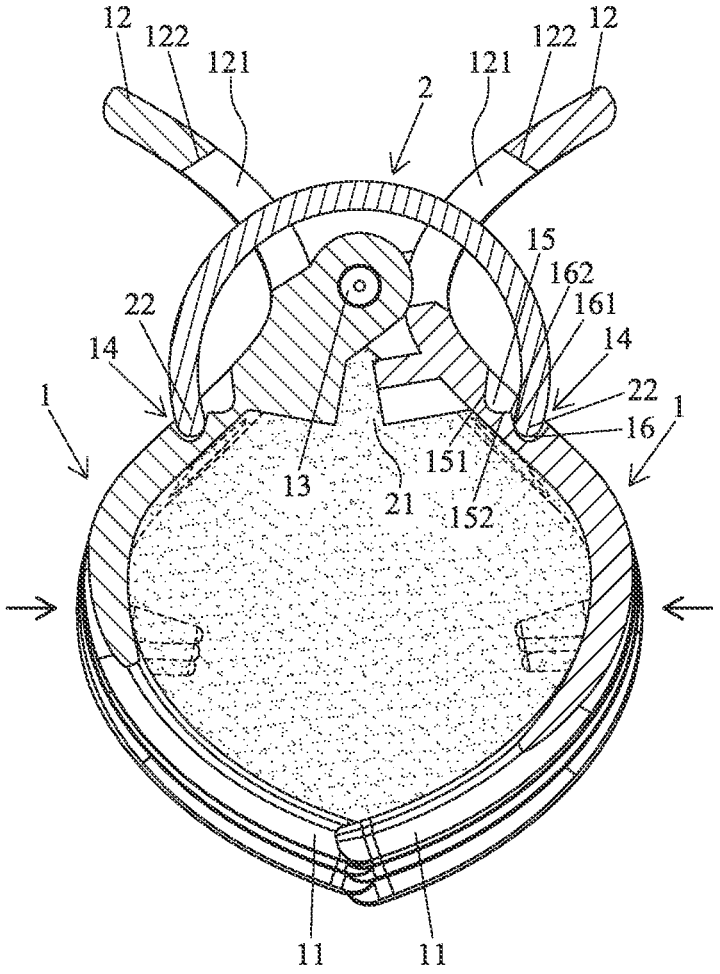
FIG. 6 is a schematic cross sectional view illustrating hair clamping by the hairclip of the first embodiment according to the present invention.

With reference to FIG. 5, the two pressing portions 12 can be moved further closer, and the pressing sides 122 press against the top end of the elastic element 2 to cause downward movement of the elastic element 2. Thus, the two ends 22 of the elastic element 2 are subjected to a force to expand outward, thereby moving to the second coupling grooves 16. Furthermore, each second retaining side 161 can shift to a position clamping the respective end 22 of the elastic element 2. Thus, each of the two ends 22 can be stably retained and positioned by the respective second retaining side 161. Furthermore, the first inclined guiding side 152 and the second inclined guiding side 162 provide enhanced smooth movement for the two ends 22 of the elastic element 2, and the spacing D5 between the two ends 22 at this state is greater than the spacing D4.

The second retaining side 161 of each second coupling groove 16 according to the present invention can retain a respective one of the two ends 22 of the elastic element 2 when the two clip bodies 1 are opened. Furthermore, when the two clip bodies 1 are closed to a predetermined angular position, the second retaining side 161 of each second coupling groove 16 does not retain the respective one of the two ends 22 of the elastic element 2 in response to the change in the angular position, thereby automatically adjusting the clamping force and the spacing between the two ends 22 of the elastic element 2.

Figure 7:
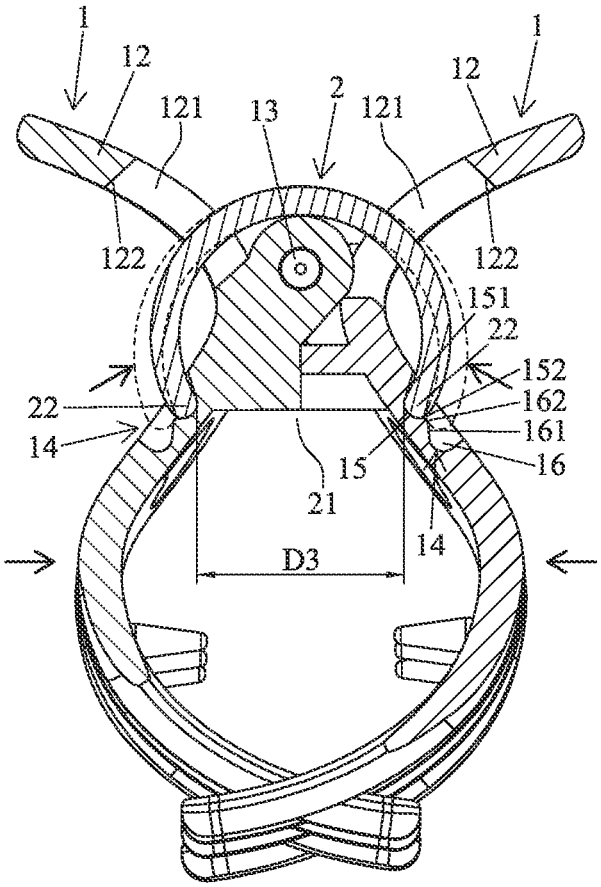
FIG. 7 is a schematic cross sectional view of the hairclip of the first embodiment according to the present invention, illustrating returning of the two clip bodies to a state not clamping hair.

With reference to FIG. 7, when the hairclip of the present invention is not in use, the two clamp portions 11 can be pivoted downward. Furthermore, the angular position of each second retaining side 161 is changed, such that the elastic returning force of the elastic element 2 causes each of the two ends 22 to disengage from the respective second retaining side 161 and to move along the respective second inclined guiding side 162 to the respective first coupling groove 15 for positioning purposes. Furthermore, the two ends 22 of the elastic element 2 have a smaller spacing D3 corresponding to coupling with the first coupling grooves 15. Furthermore, when not in use, the elastic element 2 will not retain in the larger expanded extent to prevent the elastic element 2 from elastic fatigue while prolonging the service lives of the elastic element 2 and the hairclip.

Furthermore, when only a small amount of hair (not shown) is to be clamped by the two clip bodies 1, since the opening angle of the two clip bodies 1 is smaller, the change in the angular position of each second retaining side 161 also enables the respective one of the two ends 22 of the elastic element 2 not to be retained by the respective second retaining side 16 and automatically displaces to the respective first coupling groove 15 for positioning purposes. The clamping force between each of the two ends 22 of the elastic element 2 and the respective first coupling groove 15 provides stable clamping of the small amount of hair. Furthermore, the spacing between the two ends 22 of the elastic element 2 can be reduced to avoid elastic fatigue.

Figure 8:
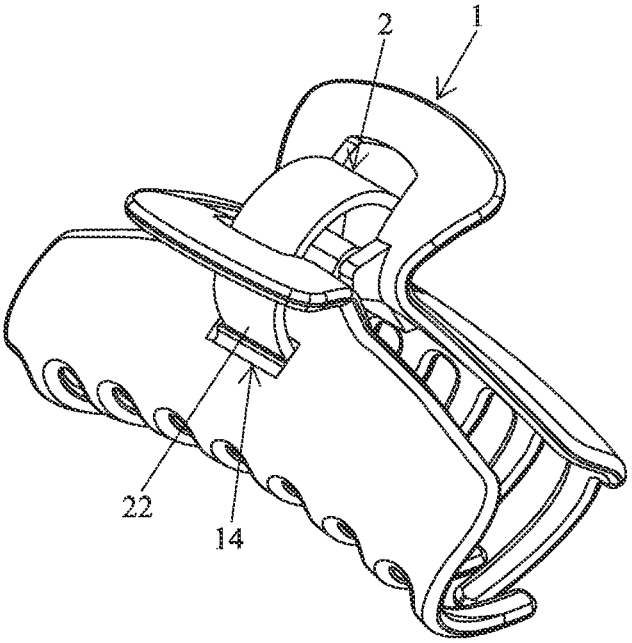
FIG. 8 is a perspective view of a hairclip of a second embodiment according to the present invention
Figure 9:
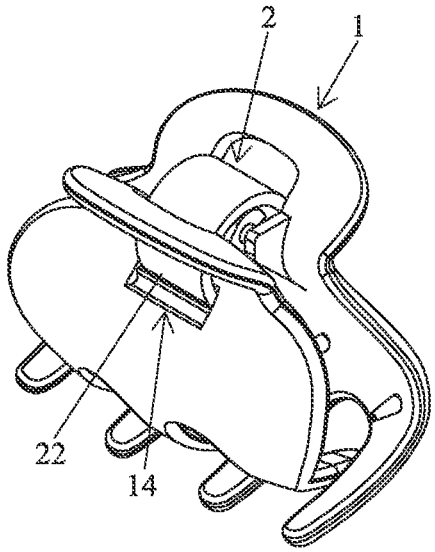
FIG. 9 is a perspective view of a hairclip of a third embodiment according to the present invention
Figure 10:
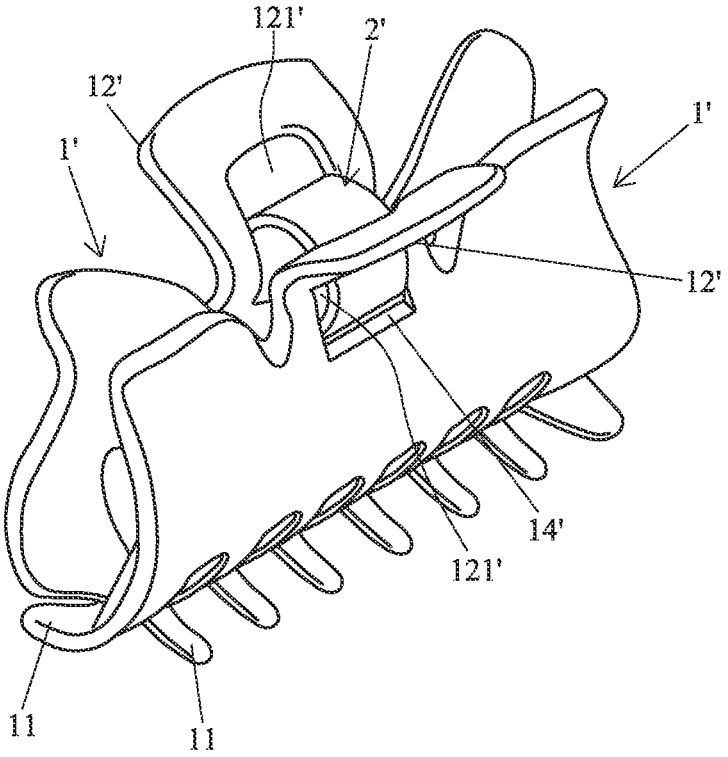
PRIOR ART Fig. 10
FIG. 10 is a perspective view of a hairclip according to the prior art.
Figure 11:
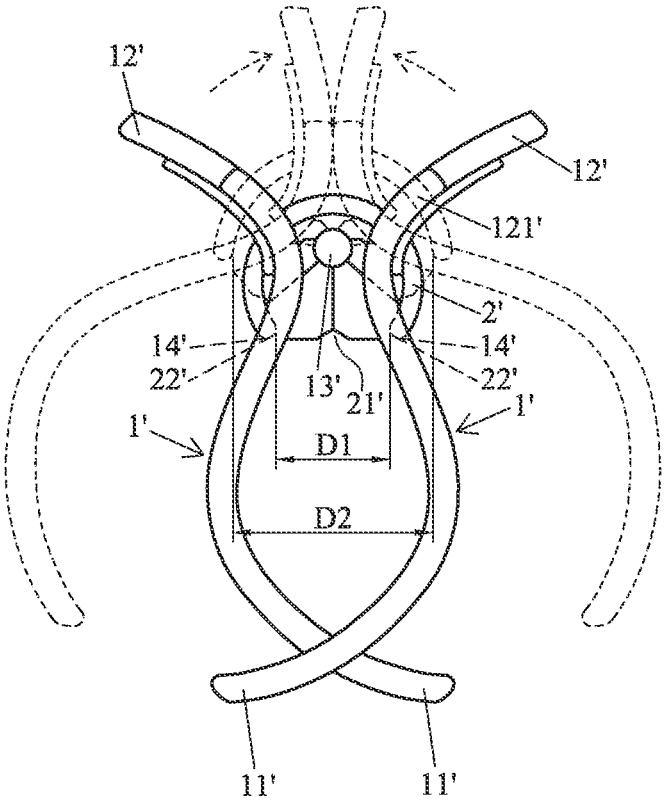
PRIOR ART Fig. 11
FIG. 11 is a cross-sectional view of the hairclip according to the prior art.

The clip bodies 1 according to the present invention may have various styles, such as the second and third embodiments respectively shown in FIGS. 8 and 9. Each embodiment includes the coupling portions 14 and the elastic element 2 coupled with the coupling portions 14 as the first embodiment.

In view of the foregoing, the hairclip according to the present invention provides automatic adjustment and enhanced clamping force while reducing the elastic fatigue of the elastic element.

Although specific embodiments have been illustrated and described, numerous modifications and variations are still possible without departing from the scope of the invention. The scope of the invention is limited by the accompanying claims.

The invention claimed is:

1. A hairclip comprising: two clip bodies pivotably connected to one another, wherein each of the two clip bodies includes a clamp portion at a lower end thereof, and a pressing portion at an upper end thereof, wherein each pressing portion includes a through-hole having a pressing side at an upper end thereof, wherein each of the two clip bodies further includes an outer side having a coupling portion below the through-hole, and wherein the coupling portion of each of the two clip bodies includes a first coupling groove adjacent to the through-hole and a second coupling groove adjacent to the first coupling groove; and an elastic element in a form of an arcuate member, wherein the elastic element includes two ends delimiting an opening at a lower end of the elastic element, wherein the elastic element extends through the through-holes of the two clip bodies, wherein each of the two ends of the elastic element is coupled with the first coupling groove of a respective one of the two clip bodies, wherein when the two clip bodies are opened, each pressing side presses against the elastic element and causes displacement of a respective one of the two ends of the elastic element to couple with the second coupling groove of the respective one of the two clip bodies, wherein when the two clip bodies are closed to an extent where the second coupling grooves are incapable of retaining the two ends of the elastic element, the two ends of the elastic element automatically disengage from the second coupling grooves and displace to a position to engage the first coupling grooves of the two clip bodies.

2. The hairclip as claimed in claim 1, wherein the first coupling groove of each of the two clip bodies includes a first retaining side extending toward the throughhole and a first inclined guiding side extending away from the through-hole and toward the second coupling groove.

3. The hairclip as claimed in claim 2, wherein the second coupling groove of each of the two clip bodies includes a second retaining side extending toward the through-hole and a second inclined guiding side located between the first inclined guiding side and the second retaining side.

4. The hairclip as claimed in claim 3, wherein where the two clip bodies are pivoted open and the two ends of the elastic element are disposed, respectively, in the second coupling grooves, each second retaining side retains a respective one of the two ends of the elastic element.

5. The hairclip as claimed in claim 3, wherein when an opening angle between the two clip bodies is smaller than a predetermined angle, each second retaining sides does not retain a respective one of the two ends of the elastic element.

6. The hairclip as claimed in claim 1, wherein the elastic element is made of elastic plastic material.

7. The hairclip as claimed in claim 6, wherein the arcuate member is C-shaped ring having an arcuate extent greater than 180 degrees.

* * * * *